US012042855B2

(12) United States Patent
Jin et al.

(10) Patent No.: US 12,042,855 B2
(45) Date of Patent: Jul. 23, 2024

(54) SYSTEMS, FORMULATIONS, AND METHODS FOR REMOVAL OF CERAMIC CORES FROM TURBINE BLADES AFTER CASTING

(71) Applicant: RAYTHEON TECHNOLOGIES CORPORATION, Farmington, CT (US)

(72) Inventors: Lei Jin, Unionville, CT (US); Ryan C. Breneman, Newington, CT (US); David Brayshaw, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/713,386

(22) Filed: Apr. 5, 2022

(65) Prior Publication Data

US 2022/0266333 A1 Aug. 25, 2022

Related U.S. Application Data

(62) Division of application No. 16/691,670, filed on Nov. 22, 2019, now Pat. No. 11,370,021.

(51) Int. Cl.
*B22D 29/00* (2006.01)
*C23F 11/12* (2006.01)

(52) U.S. Cl.
CPC ..... *B22D 29/002* (2013.01); *B22D 29/003* (2013.01); *C23F 11/124* (2013.01)

(58) Field of Classification Search
CPC ..... C23F 11/124
See application file for complete search history.

(56) References Cited

U.S. PATENT DOCUMENTS 2,992,997 A 7/1961 Arden et al.
3,802,836 A * 4/1974 Speck ..... C09B 29/366 534/832
4,599,195 A * 7/1986 Schafer ..... C11D 1/06 510/488
4,708,805 A * 11/1987 D'Muhala ..... C02F 5/12 210/698
5,074,972 A 12/1991 Matz
5,679,270 A 10/1997 Thornton et al.
5,778,963 A 7/1998 Parille et al.
5,779,809 A 7/1998 Sangeeta
7,240,718 B2 7/2007 Schmidt et al.
2003/0004081 A1 1/2003 Ellis et al.
2010/0089768 A1 4/2010 Jensen et al.
2011/0048665 A1 3/2011 Schlienger et al.
2015/0111382 A1 4/2015 Shinoda

FOREIGN PATENT DOCUMENTS

CN 107866550 4/2018

OTHER PUBLICATIONS

USPTO; Restriction Requirement dated Apr. 19, 2021 in U.S. Appl. No. 16/691,670.
USPTO, Pre-Interview First Office Action dated May 28, 2021 in U.S. Appl. No. 16/691,670.
USPTO, First Action Interview dated Sep. 9, 2021 in U.S. Appl. No. 16/691,670.
USPTO, Notice of Allowance dated Feb. 24, 2022 in U.S. Appl. No. 16/691,670.
European Patent Office, European Search Report dated Apr. 1, 2021 in Application No. 20209063.5.

* cited by examiner

*Primary Examiner* — Peter F Godenschwager
(74) *Attorney, Agent, or Firm* — SNELL & WILMER L.L.P.

(57) ABSTRACT

A solution is provided and includes a strong base, a corrosion inhibitor, wherein the strong base is an alkali metal hydroxide, wherein the corrosion inhibitor is at least one of an organic acid having a-COOH functional group or an alkali metal salt of one of an organic acid having a-COOH functional group.

5 Claims, 18 Drawing Sheets

CONTROL 22.5% KOH

Control 22.5% KOH, 96 h, 5000x

Control 22.5% KOH, 96 h, 1000x

SYSTEMS, FORMULATIONS, AND METHODS FOR REMOVAL OF CERAMIC CORES FROM TURBINE BLADES AFTER CASTING

CROSS-REFERENCE TO RELATED APPLICATIONS

This application is a divisional of, and claims priority to, and the benefit of Non-Provisional application Ser. No. 16/691,670, filed Nov. 22, 2019 for SYSTEMS, FORMULATIONS, AND METHODS FOR REMOVAL OF CERAMIC CORES FROM TURBINE BLADES AFTER CASTING, which is incorporated in its entirety by reference herein for all purposes.

FIELD

The disclosure relates generally to airfoils in gas turbine engines and systems and methods for manufacturing airfoil castings.

BACKGROUND

Gas turbine engine airfoils are often manufactured by casting. The investment casing process of nickel super alloy typically includes the use of silica castings that are removed after casting to reveal voids that are useful for conducting fluid flow, for example cooling fluid flow. Current processes for removing the silica castings may be time consuming and may etch or otherwise mar the airfoil.

SUMMARY

The foregoing features and elements may be combined in various combinations without exclusivity, unless expressly indicated herein otherwise. These features and elements as well as the operation of the disclosed embodiments will become more apparent in light of the following description and accompanying drawings.

In various embodiments, a solution is provided herein comprising a strong base and a corrosion inhibitor, wherein the strong base is an alkali metal hydroxide, wherein the corrosion inhibitor is at least one of an organic acid having a-COOH functional group or an alkali metal salt of one of an organic acid having a-COOH functional group.

In various embodiments, the strong base is at least one of sodium hydroxide or potassium hydroxide.

In various embodiments, the corrosion inhibitor is at least one of tartaric acid, sodium tartrate, citric acid, acetic acid, oxalic acid, malic acid, maleic acid, lactic acid, glycine, L-histidine, or DETPA (Diethylenetriaminepentaacetate).

In various embodiments, the solution further comprises a solubility enhancer.

In various embodiments, the solubility enhancer is Ethylenediaminetetraacetic acid (EDTA).

In various embodiments, the strong base is KOH, wherein the KOH has a concentration of between 5.54M to 11.09M.

In various embodiments, the corrosion inhibitor is sodium tartrate, wherein the sodium tartrate has a concentration of between 1 mg/L and 10 g/L.

In various embodiments, the solution further comprises a solubility enhancer comprising Ethylenediaminetetraacetic acid (EDTA), wherein the EDTA has a concentration of between 1 mg/L and 30 g/L.

In various embodiments, a method is provided comprising placing a metallic aircraft part having a ceramic material disposed therein into a vessel, placing a solution into the vessel, the solution comprising, a strong base, and a corrosion inhibitor, wherein the strong base is an alkali metal hydroxide, wherein the corrosion inhibitor is at least one of an organic acid having a-COOH functional group or an alkali metal salt of one of an organic acid having a-COOH functional group.

In various embodiments, the method further comprises heating the vessel to an elevated temperature.

In various embodiments, the method further comprises increasing the pressure within the vessel to above atmospheric pressure.

In various embodiments, the method further comprises holding the vessel at the elevated temperature and above atmospheric pressure for between four hours and ninety six hours.

In various embodiments, the method further comprises holding the vessel at the elevated temperature and above atmospheric pressure until substantially all the ceramic material has dissolved.

In various embodiments, the strong base is at least one of sodium hydroxide or potassium hydroxide.

In various embodiments, the corrosion inhibitor is at least one of tartaric acid, sodium tartrate, citric acid, acetic acid, oxalic acid, malic acid, maleic acid, lactic acid, glycine, L-histidine, or DETPA (Diethylenetriaminepentaacetate).

In various embodiments, the method further comprises a solubility enhancer wherein the solubility enhancer is Ethylenediaminetetraacetic acid (EDTA).

In various embodiments, the strong base is KOH, wherein the KOH has a concentration of between 5.54M to 11.09M.

In various embodiments, the corrosion inhibitor is sodium tartrate, wherein the sodium tartrate has a concentration of between 1 mg/L and 100 g/L.

In various embodiments, a solution is provided comprising at least one of sodium hydroxide or potassium hydroxide, a corrosion inhibitor, wherein the corrosion inhibitor is at least one of tartaric acid, sodium tartrate, citric acid, acetic acid, oxalic acid, malic acid, maleic acid, lactic acid, glycine, L-histidine, or DETPA (Diethylenetriaminepentaacetate).

In various embodiments, the corrosion inhibitor is sodium tartrate, wherein the sodium tartrate has a concentration of between 1 mg/L and 100 g/L.

BRIEF DESCRIPTION OF THE DRAWINGS

The subject matter of the present disclosure is particularly pointed out and distinctly claimed in the concluding portion of the specification. A more complete understanding of the present disclosures, however, may best be obtained by referring to the detailed description and claims when considered in connection with the drawing figures, wherein like numerals denote like elements.

DETAILED DESCRIPTION

Figure 1A:
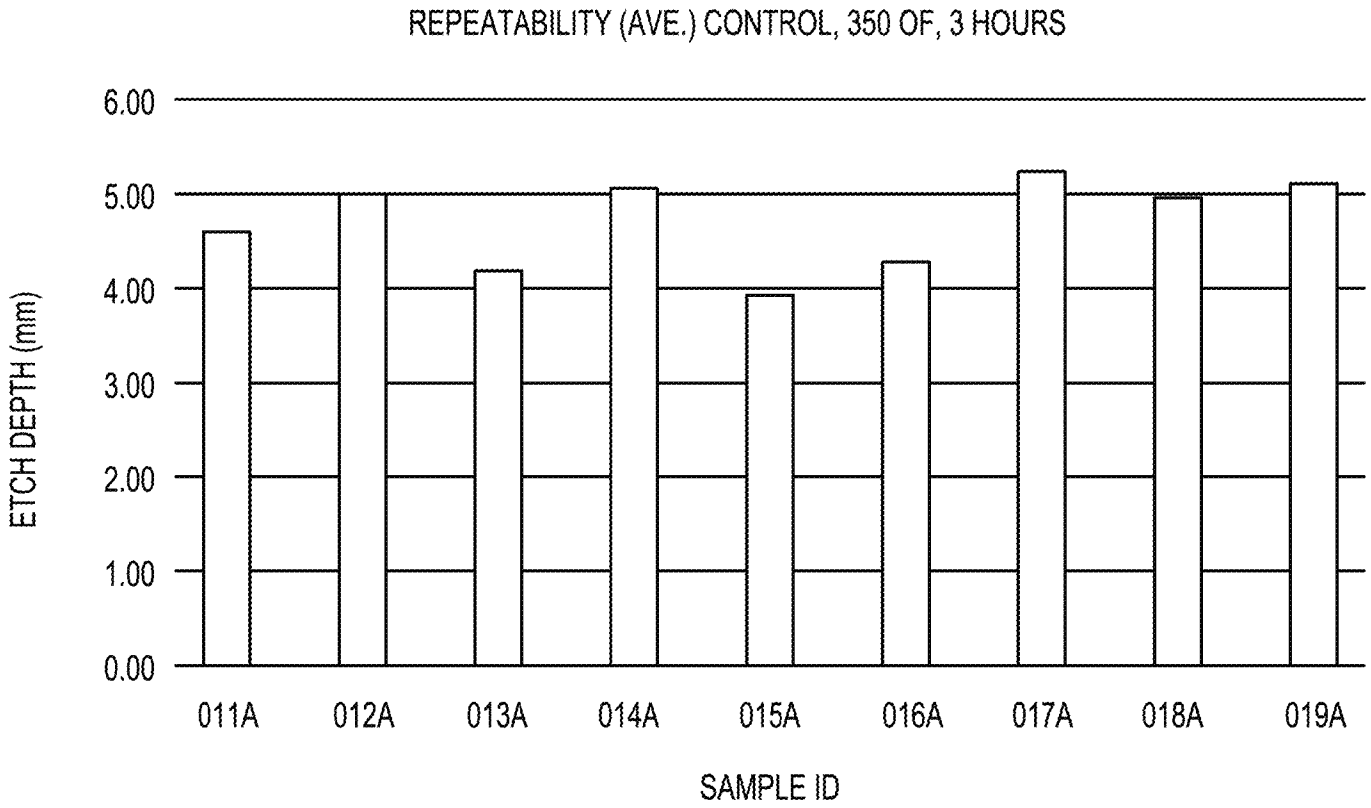
FIG. 1A illustrates a control data set of etch depth.

The detailed description of exemplary embodiments herein makes reference to the accompanying drawings, which show exemplary embodiments by way of illustration and their best mode. While these exemplary embodiments are described in sufficient detail to enable those skilled in the art to practice the disclosures, it should be understood that other embodiments may be realized and that logical, chemical, and mechanical changes may be made without departing from the spirit and scope of the disclosures. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Gas turbine engines may comprise a compressor, to compress a fluid such as air, a combustor, to mix the compressed air with fuel and ignite the mixture, and a turbine to extract kinetic energy from the expanding gases that result from the ignition. The compressor rotors may be configured to compress and spin a fluid flow. Stators may be configured to receive and direct the fluid flow. In operation, the fluid flow discharged from the trailing edge of stators may be turned toward the axial direction or otherwise directed to increase and/or improve the efficiency of the engine and, more specifically, to achieve maximum and/or near maximum compression and efficiency when the air is compressed and spun by a rotor.

In various embodiments, the turbine rotors may be configured to expand and reduce the swirl of the fluid flow. Stators may be configured to receive and turn the fluid flow. In operation, the fluid flow discharged from the trailing edge of stators may be turned away from the axial direction to enable the extraction of shaft power from the fluid and, more specifically, to achieve maximum and/or near maximum expansion of the fluid and efficiency when the swirled air is expanded by the turbine rotor. In various embodiments, the systems and methods described herein may be useful in the production of airfoils and related components, such as discs.

Aircraft components such as discs may be cast by pouring molten metal over a ceramic material. The molten metal materials are often nickel superalloys, for example, austenitic nickel-chromium-based superalloys, such as that sold under the mark INCONEL. In various embodiments, the ceramic material may comprise silica ($SiO_2$), alumina ($Al_2O_3$), zircon ($ZrSiO_4$), magnesia (MgO), and/or mixtures of two or more of the same, though in various embodiments other mixtures of oxides and other ceramics may be used. The ceramic material may then be dissolved or otherwise removed to leave voids in the aircraft component. These voids may be used as pathways for cooling liquid during operation. In various embodiments, a strong base is used to dissolve the ceramic material, for example under temperatures and pressures that may exceed typical room temperature (~75° F.) (~23.8 C), and pressures (~14.65 psi) (~101 kPa). However, use of high concentrations of strong bases may lead to undesirable etching or other damage to the surfaces of the aircraft component. In various embodiments, a corrosion inhibitor is used to protect the aircraft component from damage typically associated with strong bases, thus allowing for use of higher concentrations of strong bases, and, in various embodiments, at higher temperatures and pressures.

Figure 8:
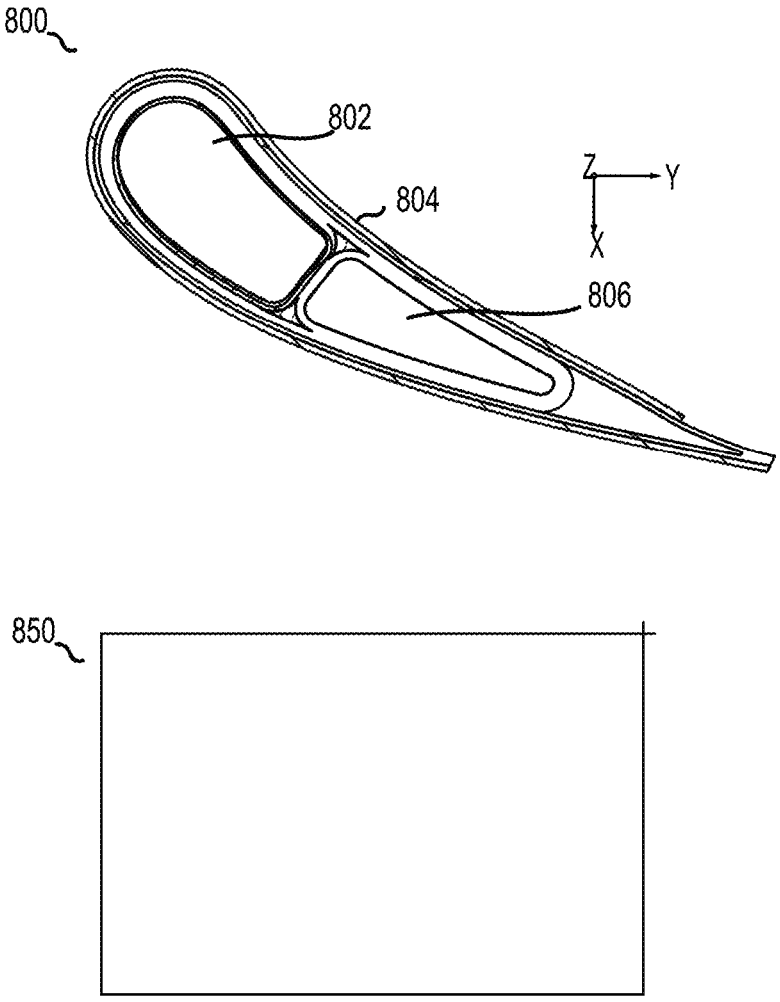
FIG. 8 illustrates a metallic aircraft part and a vessel, in accordance with various embodiments.
Figure 9:
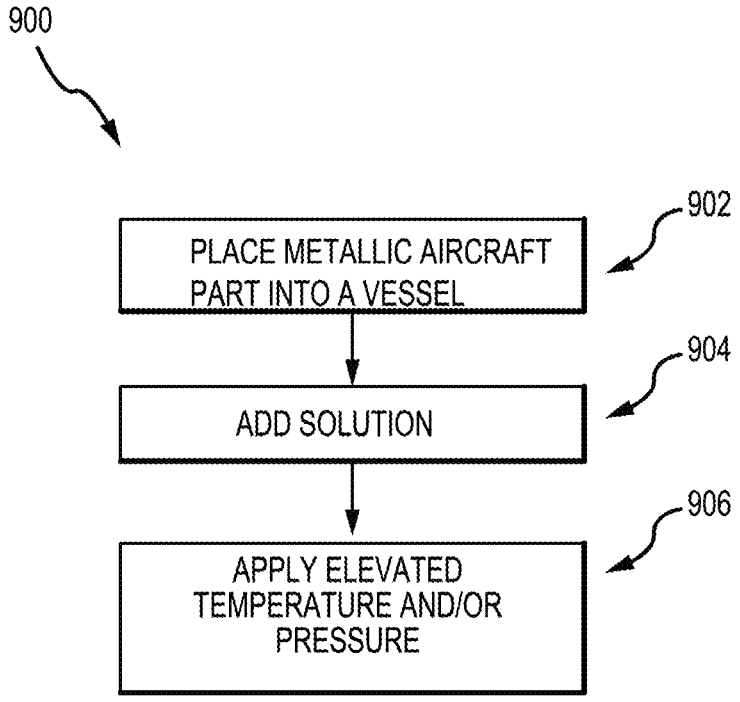
FIG. 9 illustrates a method of removing a ceramic material from a metallic aircraft part, in accordance with various embodiments.

With reference to FIGS. 8 and 9, a method of dissolving a ceramic material in a metallic aircraft component 900 is illustrated. Metallic aircraft part 800 may comprise any metallic aircraft component, including cast and forged metallic aircraft components, though in various embodiments the metallic aircraft component is cast. Metallic aircraft part 800 may comprise an airfoil body 804 and one or more ceramic inserts, including insert 802 and insert 806. During casting, insert 802 and insert 806 may be surrounded by molten metal. After the metal solidifies, it is desirable to remove insert 802 and insert 806 to leave voids, voids which may be used to conduct cooling fluid. Insert 802 and insert 806 may comprise any suitable ceramic, though in various embodiments, insert 802 and insert 806 comprise silicon dioxide. Vessel 850 may comprise any vessel capable of providing heat to the contents of the interior and, in various embodiments, be configured to be sealed from the atmosphere and configured to withstand interior pressures of greater than 100 kPa. Vessel 850 may comprise any suitable geometry, including rectangular and cylindrical. Vessel 850 may comprise an autoclave. A solution, as described herein, may be placed into vessel 850. In step 902, the metallic aircraft part 800 is placed into vessel 850. In step 904, a solution is added into the vessel 850 to at least partially cover and/or submerge the metallic aircraft part 800. The solution, as described in more detail below, may include a strong base and a corrosion inhibitor. In step 906, heat is applied to elevate the temperature within the vessel 850. In various embodiments, pressure is increased within the vessel 850. This pressure increase may be the result of the heating of the solution within a closed space.

Figure 10:
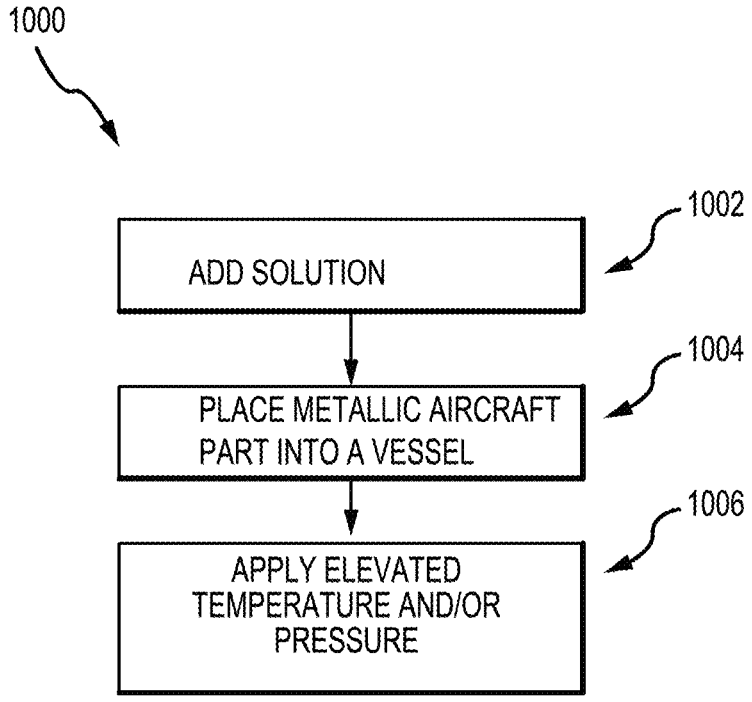
FIG. 10 illustrates a method of removing a ceramic material from a metallic aircraft part, in accordance with various embodiments.

With reference to FIGS. 8 and 10, process 1000 is illustrated. In step 1002, a solution is added into the vessel 850. In step 1004, the metallic aircraft part 800 is placed into vessel 850, becoming at least partially or totally submerged in the solution. In step 1006, heat is applied to elevate the temperature within the vessel 850. In various embodiments, pressure is increased within the vessel 850. This pressure increase may be the result of the heating of the solution within a closed space.

In various embodiments, the solution comprises a strong base and a corrosion inhibitor. In various embodiments, the strong base is an alkali metal hydroxide such as potassium hydroxide (KOH), sodium hydroxide (NaOH), lithium hydroxide (LiOH), rubidium hydroxide (RbOH) and cesium hydroxide (CsOH). In various embodiments, the strong base has a concentration of at least one of between 2M and 18M, between 4M and 15M, and between 5.54M to 11.09M. In various embodiments, the solution comprises KOH in a concentration of at least one of between 2M and 18M, between 4M and 15M, and between 5.54M (22.5 wt. %) to 11.09M (45 wt. %).

In various embodiments, the solution comprises a corrosion inhibitor, the corrosion inhibitor comprising at least one of an organic acid having a-COOH functional group or an alkali metal salt one of an organic acid having a-COOH functional groups. In various embodiments, the corrosion inhibitor is at least one of tartaric acid, sodium tartrate, citric acid, acetic acid, oxalic acid, malic acid, maleic acid, lactic acid, glycine, L-histidine, or DETPA (Diethylenetriamine-pentaacetate). For example, in various embodiments, the corrosion inhibitor has a concentration of at least one of 1 ppm, between 1 mg/L and 15 g/L, between 0.5 g/L and 10 g/L, and between 1 g/L and 5 g/L. In various embodiments, the corrosion inhibitor comprises sodium tartrate at a concentration of at least one of between 1 mg/L and 15 g/L, between 0.1 g/L and 15 g/L, between 0.5 g/L and 10 g/L, between 0.5 g/L and 100 g/L and between 1 g/L and 5 g/L. In various embodiments, the corrosion inhibitor has a concentration at least 1 ppm.

In various embodiments, the solution further comprises a solubility enhancer. The solubility enhancer may comprise Ethylenediaminetetraacetic acid (EDTA). For example, in various embodiments, the solubility enhancer comprises solubility enhancer at a concentration of at least one of between 1 mg/L and 50 g/L, between 5 g/L and 50 g/L, between 10 g/L and 30 g/L, and between 15 g/L and 25 g/L. In various embodiments, the solubility enhancer has a concentration at least 1 ppm.

In step 906 and/or step 1006, the solution may be heated to a desired temperature of at least one of between 150 degrees Fahrenheit (65.5 C) to 500 degrees Fahrenheit (260 C), between 250 degrees Fahrenheit (121.1 C) to 400 degrees Fahrenheit (204.4 C), and between 300 degrees Fahrenheit (148.8 C) to 375 degrees Fahrenheit (190.5 C). In various embodiments, the solution is heated 350 degrees Fahrenheit (176.6 C). The vessel may be kept at the desired temperature for a period of time ranging from at least one of one half hour to 5 hours, one hour to 7 hours, and 2 hours to 3 hours. In various embodiments, the vessel is kept at the desired temperature for 2 hours.

In step 906 and/or step 1006, the solution may be subjected to a desired pressure of at least one of between 50 psi (344.7 kPa) and 150 psi (1043 kPa), 75 psi (517.1 kPa) and 125 psi (861.8 kPa), and 90 psi (620.5 kPa) and 200 psi (1379 kPa). In various embodiments the desired pressure may be 100 PSI (689.5 kPa). In various embodiments, step 906 may be repeated in a number of cycles. In various embodiments, the number of cycles ranges between 2 cycles and 10 cycles, between 4 cycles and 8 cycles, in between 6 cycles and 7 cycles. Step 906 and/or step 1006 may include holding the vessel at the elevated temperature and above atmospheric pressure until substantially all the ceramic material has dissolved.

Figure 1B:
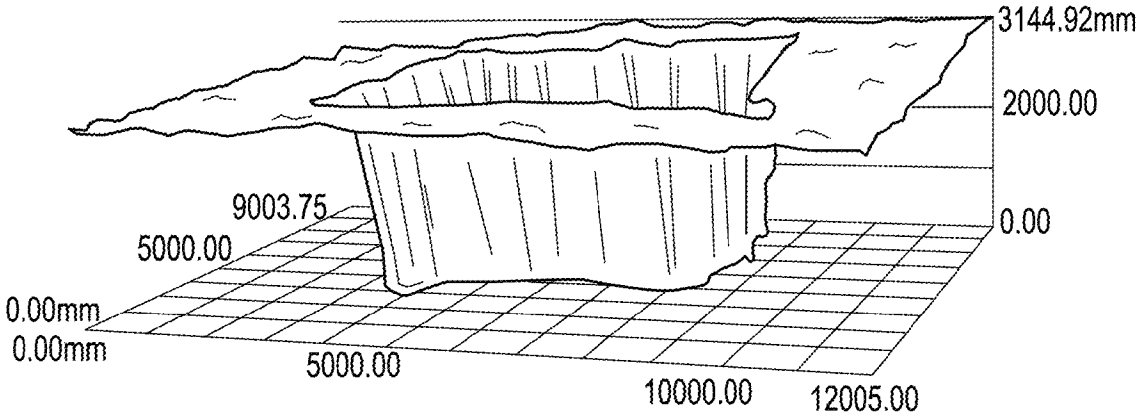
FIG. 1B illustrates a three dimensional view of etch depth in the control data set.

The processes 900 and 1000 offer various improvements over conventional methods. For example, reduced process time may be achievable in accordance with various embodiments. With reference to FIG. 1, the results of several tests are shown to illustrate control data. Samples of ceramic material (e.g., silicon dioxide, i.e., silica, i.e., $SiO_2$) disposed in contact with thermally and chemically stable materials (here, an epoxy material) were placed into an autoclave and mixed with 100 milliliters of potassium hydroxide solution. The autoclave was heated to 350 degrees Fahrenheit (176.6 C). After 3 hours at 350 degrees Fahrenheit (176.6 C), the samples were removed, and the depth of etching was determined. FIG. 1A shows each sample and the average attack depth in mm in bar graph form here. The data is also shown in TABLE 1. With reference to FIG. 1B, a 3 dimensional view of etching is depicted.

TABLE 1

| | Sample ID | Average Attacked Depth (mm) |
|---|---|---|
| 1 | 011A | 4.70 |
| 2 | 012A | 5.04 |
| 3 | 013A | 4.23 |
| 4 | 014A | 5.09 |
| 5 | 015A | 3.95 |
| 6 | 016A | 4.30 |
| 7 | 017A | 5.26 |
| 8 | 018A | 4.98 |
| 9 | 019A | 5.08 |
| Avg. | | 4.74 |
| Std. | | 0.44 |

The chemistry of this reaction proceeds generally by the reaction:

$$4OH+2SiO_2(s)\rightarrow SiO_3+Si_5O_5+2H_2O$$

It is theorized that by making the resultant silicon product more soluble in the solution, the reaction kinetics maybe be in enhanced. Thus, in various embodiments a solubility enhancer is used in the solution.

Figure 2:
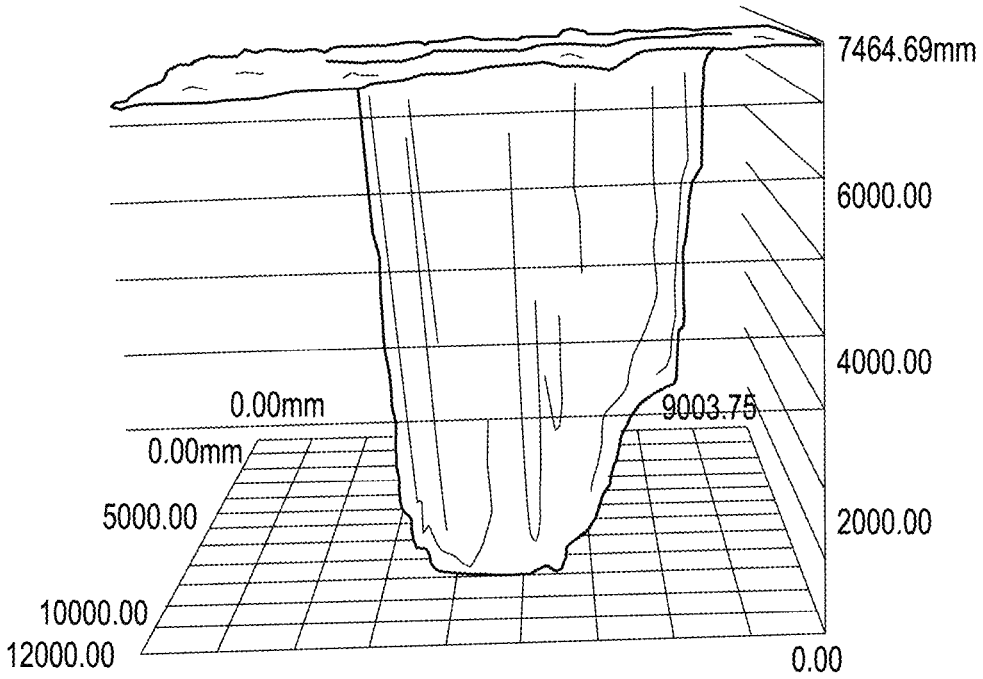
FIG. 2 illustrates a three dimensional view of etch depth, in accordance with various embodiments.

With reference to FIG. 2, additional tests were performed using solutions in accordance with various embodiments. As FIG. 2 shows, tests were run by submerging ceramic material samples disposed in contact with a nickel alloy material in a 100 ml solution of sodium hydroxide at a concentration of 200 g/L. The solution also contained EDTA at 30 g/L and sodium tartrate at 2/gL. The solution was brought to 350 degrees Fahrenheit (176.6 C) in an autoclave and maintained at that temperature for 2 hours. TABLE 2, below, illustrates the depth of attack achieved in four different tests. As shown in FIG. 2, the average depth of attack exceeds that of the control shown in FIG. 1A, yielding an average depth of attack of 5.11 mm vs. 4.74 mm in the control. It is noted that the control test was performed over 3 hours and the test shown in FIG. 2 was performed in 2 hours, resulting in a 0.37 mm increase in average depth of attack yet a reduction of one third (33%) of the process time.

TABLE 2

| Formulation Solution (NaOH 200 g/L, EDTA 30 g/L, sodium tartrate at 2/gL) | | | |
|---|---|---|---|
| Repeat | NaOH (g/L) | Time (hour) | Ave. Depth (mm) |
| 1 | 200 | 2 | 4.99 |
| 2 | 200 | 2 | 5.26 |
| 3 | 200 | 2 | 4.72 |
| 4 | 200 | 2 | 5.47 |
| Avg. | | | 5.11 |

Figure 3A:
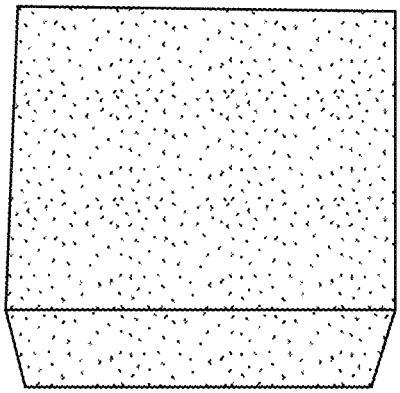
FIGS. 3A and 3B illustrate surfaces of a nickel alloy after a control process and a process, in accordance with various embodiments, respectively.
Figure 3B:
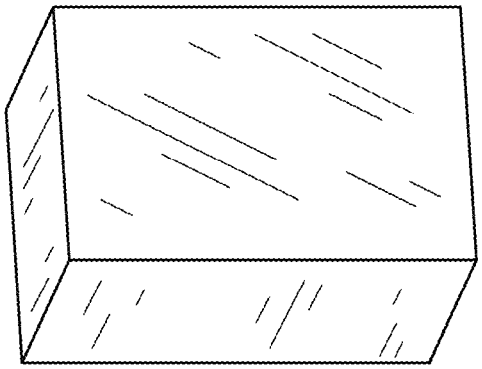

FIG. 3A shows the surface of a nickel alloy after being subjected to a 22.5% KOH solution for 68 hours at 350 degrees Fahrenheit (176.6 C). The surface of the nickel alloy exhibits a dark brown color surface, evidence that the surface has been attacked and chemically altered, for example by oxide formation. FIG. 3B shows the surface of a nickel alloy after being subjected to a 22.5% KOH solution for 68 hours at 350 degrees Fahrenheit (176.6 C), wherein the KOH solution further comprised EDTA at 30 g/L and sodium tartrate at 2/gL. As illustrated, the nickel alloy in FIG. 3B exhibits a shiny metallic color. This is evidence of no surface attack or oxide formation.

Figure 4A:
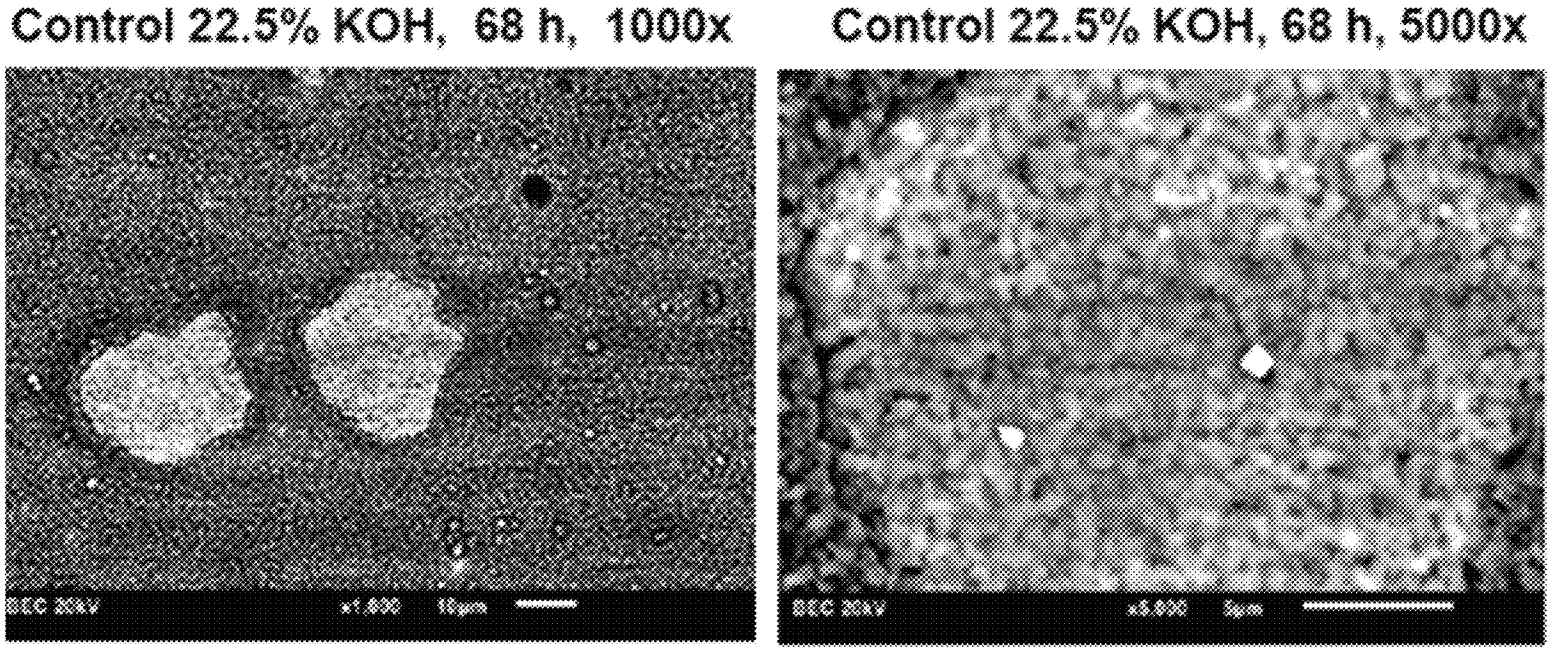
FIGS. 4A, 4B, 4C and 4D illustrate scanning electron micrographs of the surfaces of a nickel alloy shown in FIGS. 3A and 3B, respectively, in accordance with various embodiments, respectively.
Figure 4B:
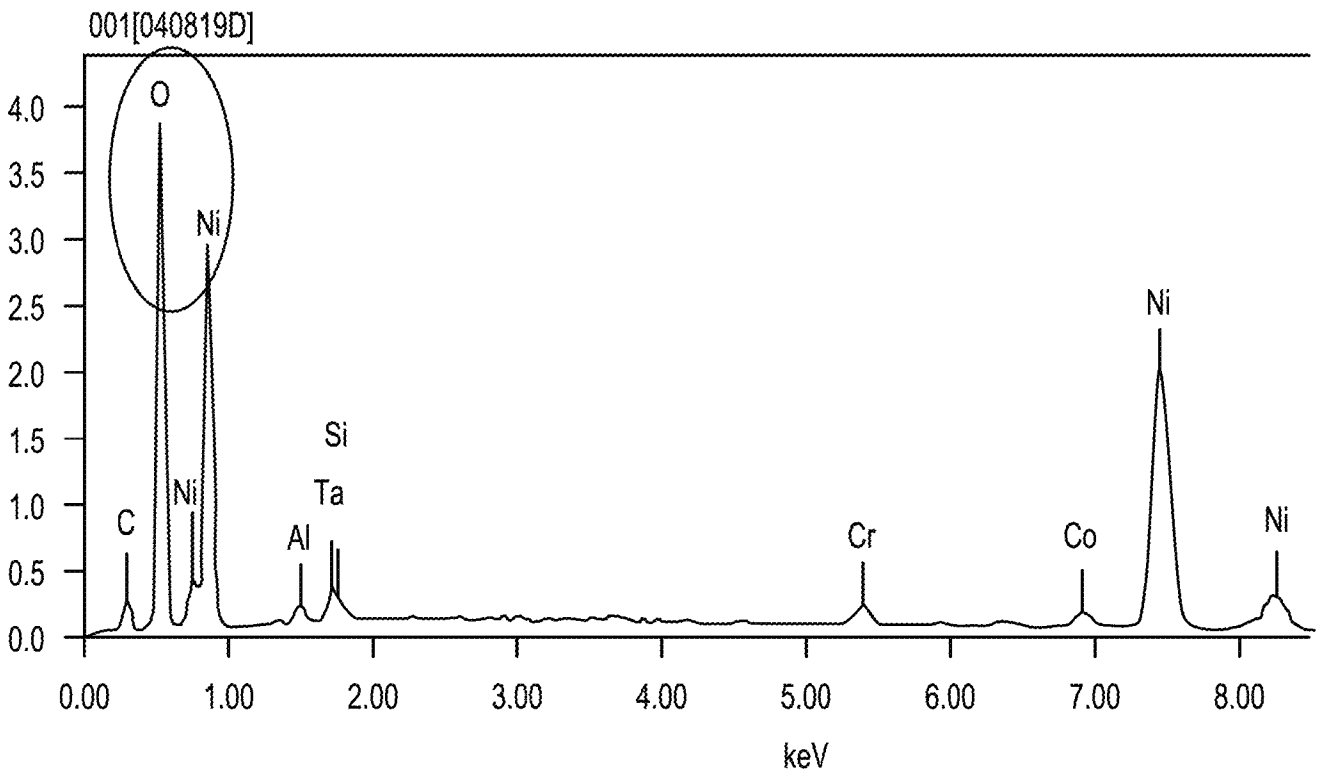

With reference to FIGS. 4A and 4B, the nickel alloy sample shown in FIG. 3A was placed under a scanning electron microscope to produce the micrographs shown in FIG. 4A. The images in FIG. 4A were taken at 1000× and 5000×, respectively. The state of the surface of the nickel alloy sample is evidenced in FIG. 4A. With reference to FIG. 4B, an elemental analysis was performed on the surface of the nickel alloy sample. Notably, the presence of oxygen (O) is shown. This is evidence of oxides that form part of the coating of the nickel alloy sample. Such oxides would be detrimental to the functioning of a nickel alloy aircraft part.

Figure 4C:
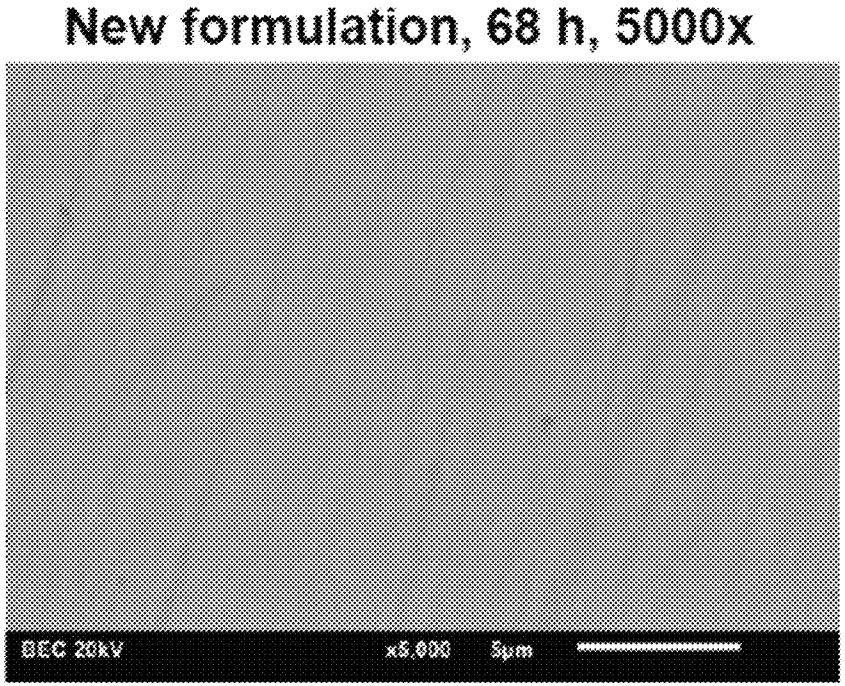
Figure 4C:
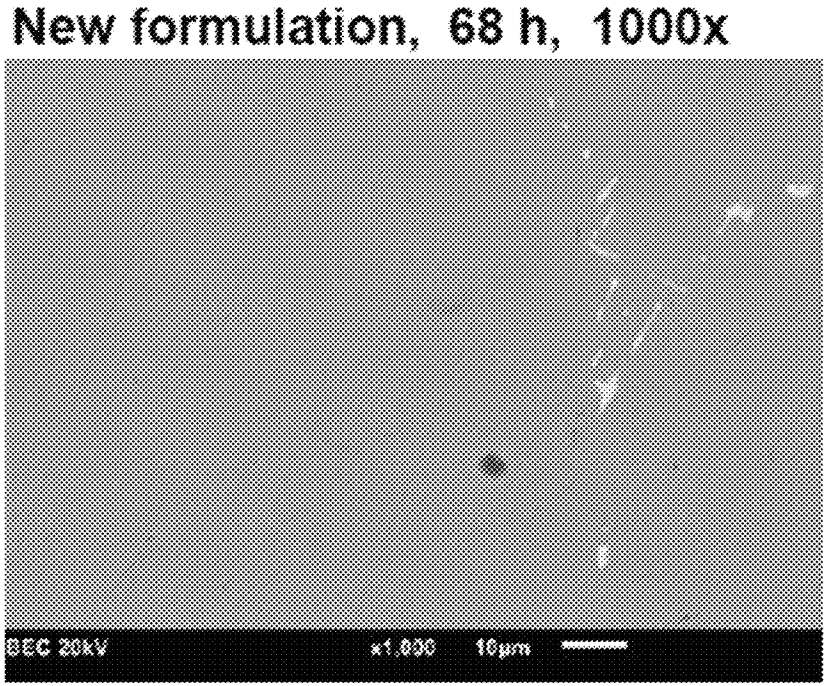
Figure 4D:
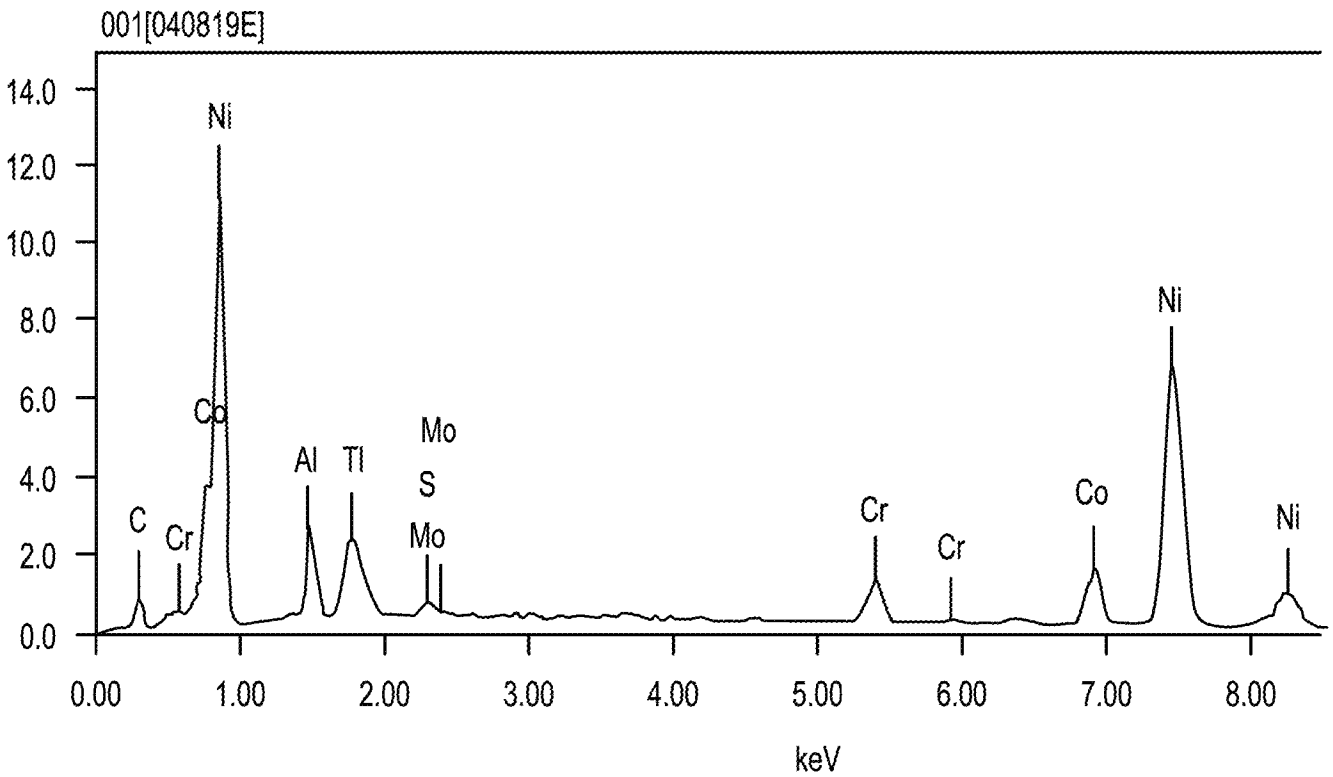

With reference to FIGS. 4C and 4D, the nickel alloy sample shown in FIG. 3B was placed under a scanning electron microscope to produce the micrographs shown in FIG. 4C. The images in FIG. 4C were taken at 1000× and 5000×, respectively. The state of the surface of the nickel alloy sample is evidenced in FIG. 4C. With reference to FIG. 4D, an elemental analysis was performed on the surface of the nickel alloy sample. Notably, there is no evidence of oxygen (O). This is evidence that no oxides are part of the coating of the nickel alloy sample. Such lack of oxides would be beneficial to the functioning of a nickel alloy aircraft part.

With reference to TABLE 3, additional tests were performed using solutions in accordance with various embodiments.

TABLE 3

Formulation: 10 g/L EDTA + 2 g/L Na Tartrate in KOH solution

| | KOH (wt. %) | Time (hour) | Avg. Depth (mm) | Increased Efficiency (average) |
|---|---|---|---|---|
| Control | 22.5 | 2 | 4.75 | No additives |
| 1 | 22.5 | 2 | 5.73 | 21% |
| 2 | 30 | 2 | 12.04 | 153% |
| 3 | 45 | 2 | 18.4 | 294% |

Figure 5A:
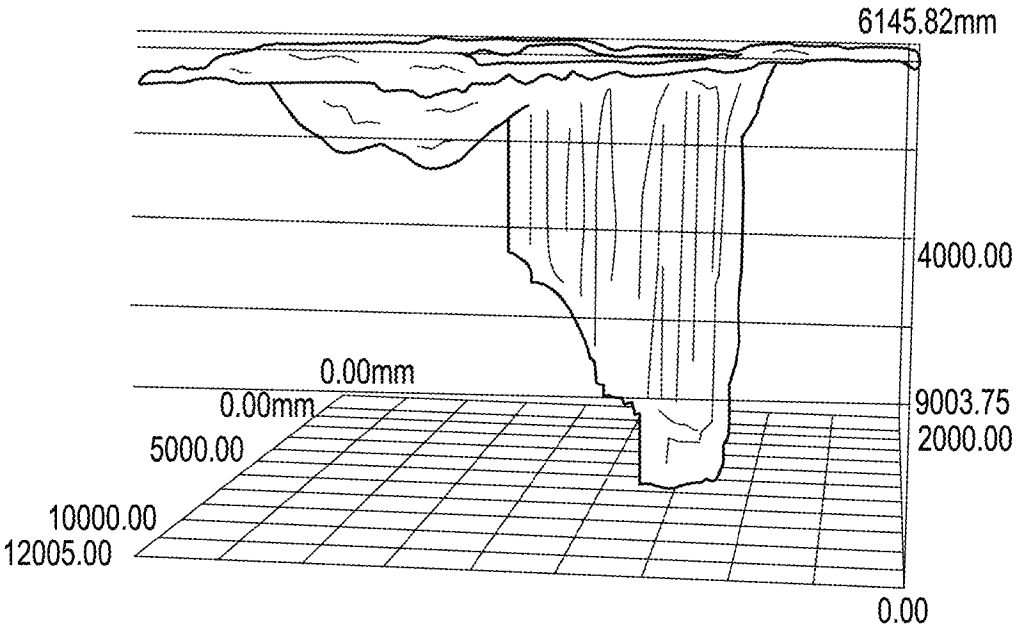
FIGS. 5A and 5B, illustrate a three dimensional view of etch depth, in accordance with various embodiments.
Figure 5B:
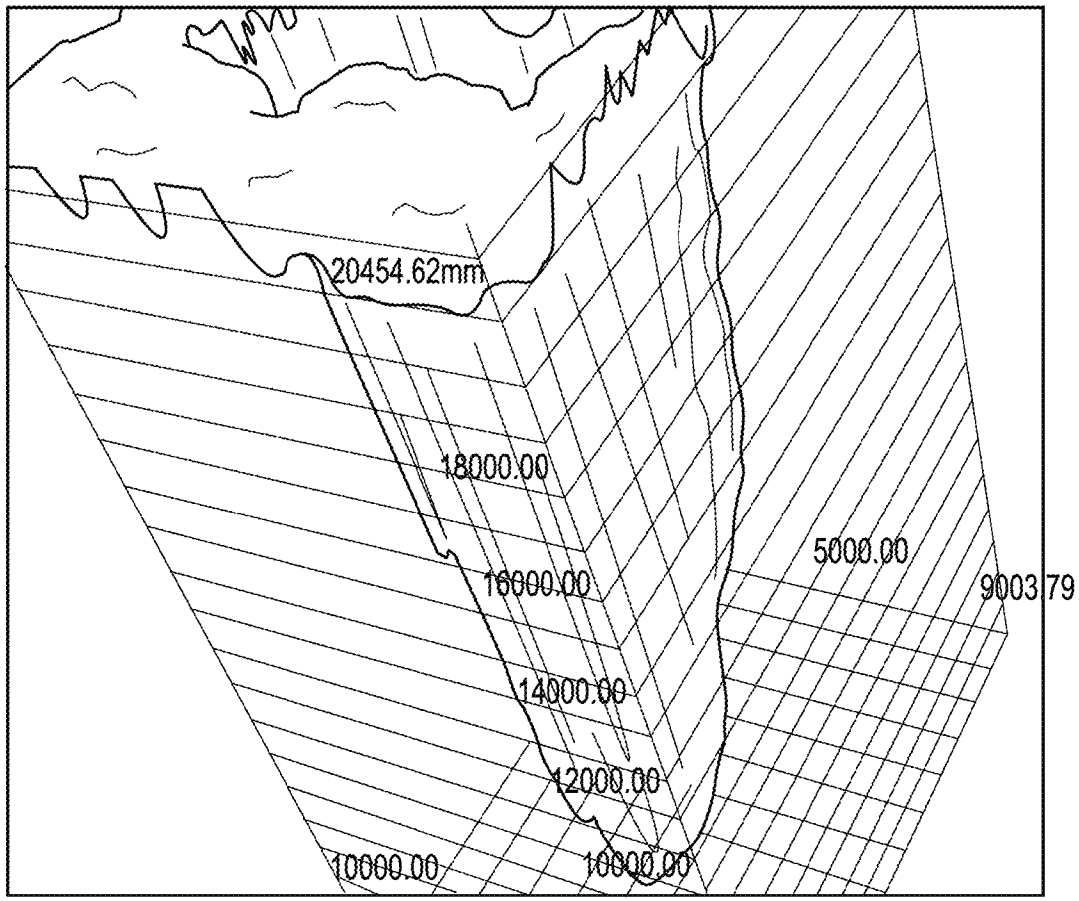

As TABLE 3 shows, tests were run by submerging ceramic material samples disposed in contact with a nickel alloy material in a 100 ml solution of potassium hydroxide. The control was performed with 22.5% wt KOH without a corrosion inhibitor or solubility enhancer. Tests 1, 2, and 3 were performed with 10 g/L EDTA+2 g/L sodium tartrate at concentrations of KOH of 22.5 wt % wt, 30 wt %, and 45 wt %, respectively. The solution was brought to 350 degrees Fahrenheit (176.6 C) in an autoclave and maintained at that temperature for 2 hours. TABLE 3, above, illustrates the depth of attack achieved in four different tests. As shown in TABLE 3, the average depth of attack exceeds that of the control, yielding an increase in efficiency of 294% against the control. FIGS. 5A and 5B illustrate the etch depth obtained in test 3. It is noted that the control test was performed over 3 hours and the test shown in FIG. 2 was performed in 2 hours, resulting in a 0.37 mm increase in average depth of attack yet a reduction of one third (33%) of the process time.

Figure 6A:
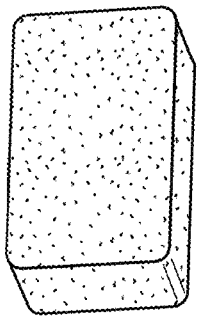
FIGS. 6A and 6B illustrate surfaces of a nickel alloy after a control process and a process, in accordance with various embodiments, respectively.
Figure 6B:
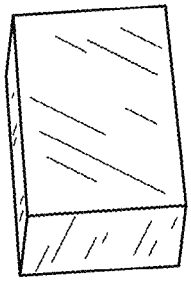

FIG. 6A shows the surface of a nickel alloy after being subjected to a 22.5% KOH solution for 96 hours at 350 degrees Fahrenheit (176.6 C). The surface of the nickel alloy exhibits a dark brown color surface, evidence that the surface has been attacked and chemically altered. FIG. 6B shows the surface of a nickel alloy after being subjected to a 45% KOH solution for 96 hours at 350 degrees Fahrenheit (176.6 C), wherein the KOH solution further comprised EDTA at 30 g/L and sodium tartrate at 2/gL. As illustrated, the nickel alloy in FIG. 6B exhibits a shiny metallic color. This is evidence of no surface attack or oxide formation.

Figure 7A:
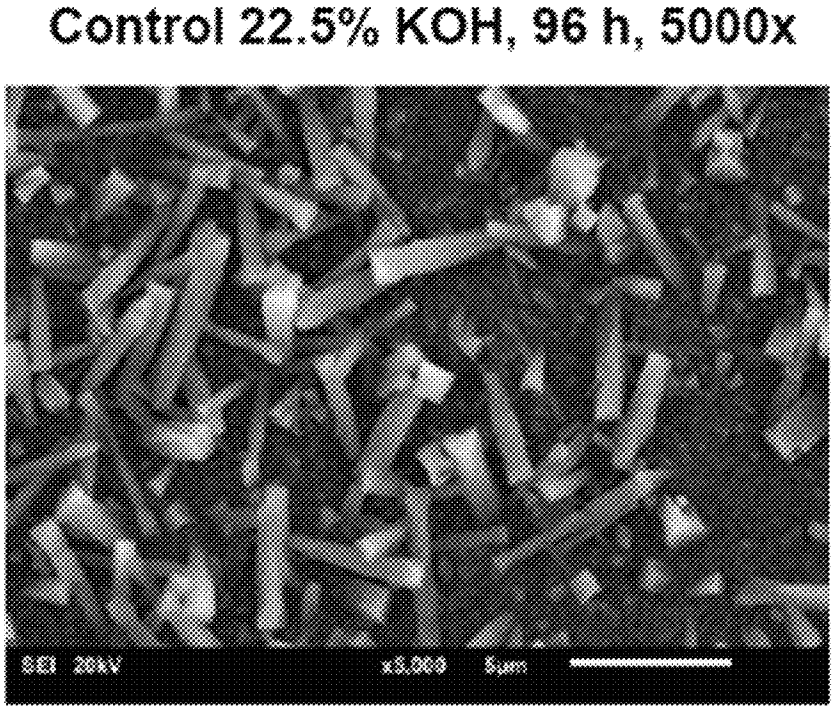
FIGS. 7A, 7B, 7C and 7D illustrate scanning electron micrographs of the surfaces of a nickel alloy shown in FIGS. 6A and 6B, respectively, in accordance with various embodiments.
Figure 7A:
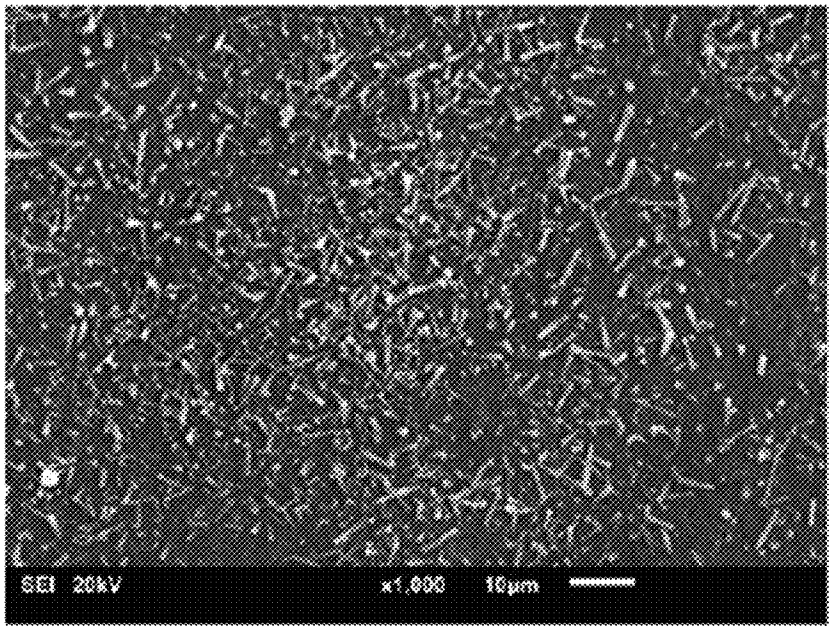
Figure 7B:
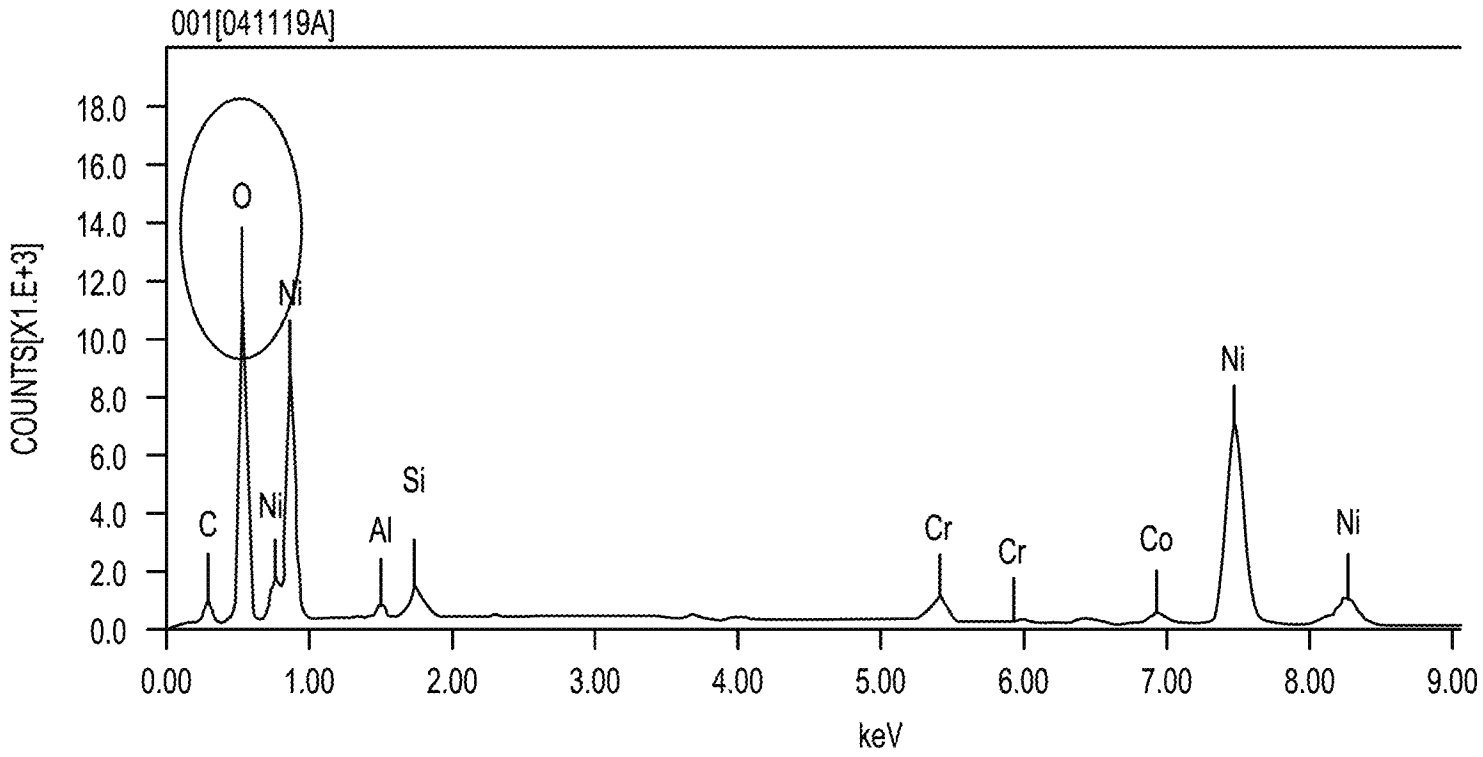

With reference to FIGS. 7A and 7B, the nickel alloys samples shown in FIG. 6A was placed under a scanning electron microscope to produce the micrographs shown in FIG. 7A. The images in FIG. 7A were taken at 1000× and 5000×, respectively. The state of the surface of the nickel alloy is evidenced in FIG. 7A. With reference to FIG. 7B, an elemental analysis was performed on the surface of the nickel alloy. Notably, the presence of oxygen (O) is shown. This is evidence of oxides that form part of the coating of the nickel metal alloy. Such oxides would be detrimental to the functioning of a nickel alloy aircraft part.

Figure 7C:
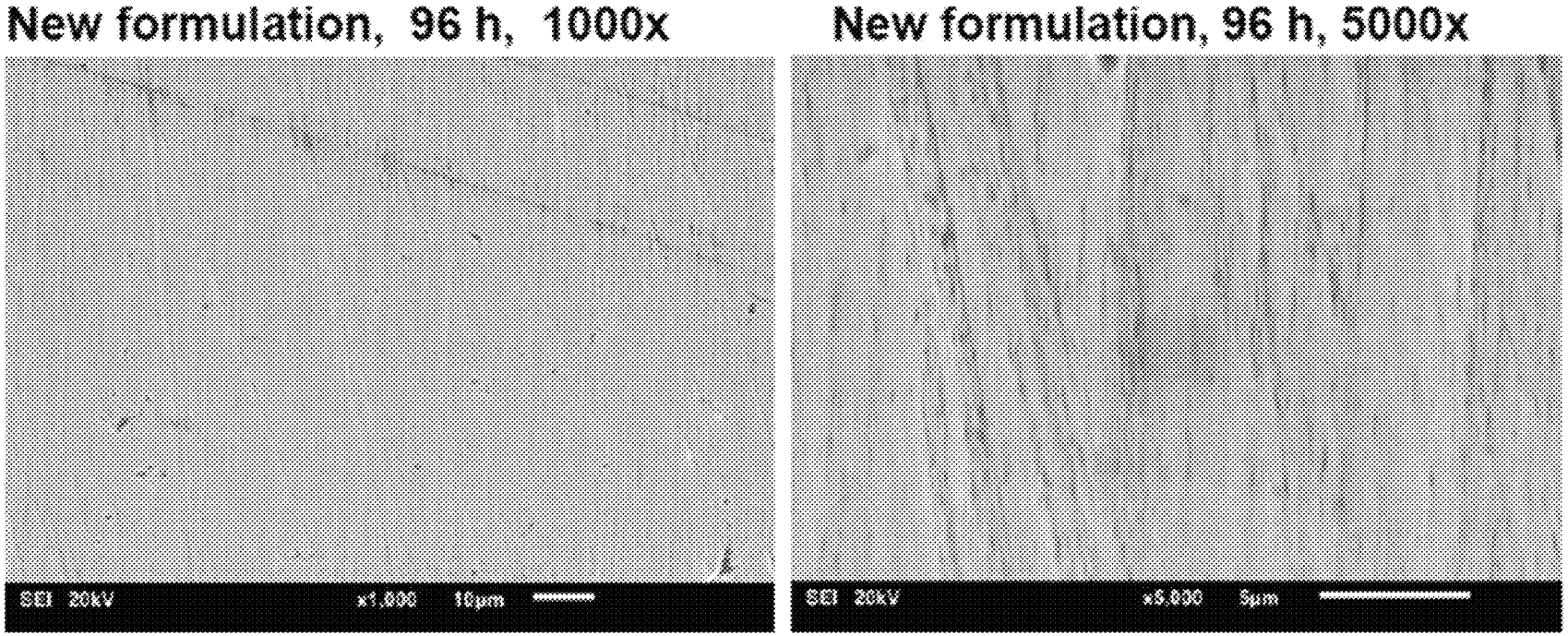
Figure 7D:
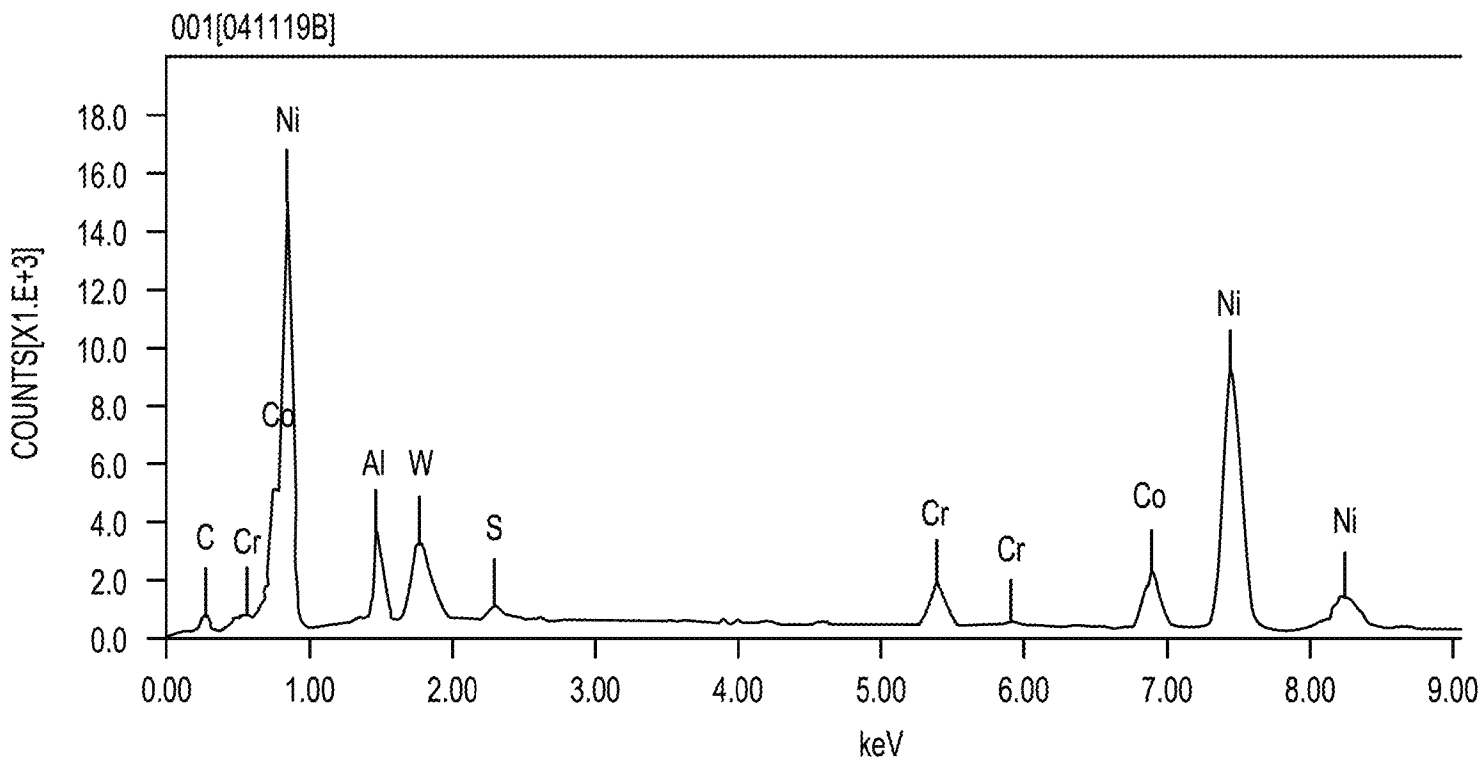

With reference to FIGS. 7C and 7D, the nickel alloys sample shown in FIG. 6B was placed under a scanning electron microscope to produce the micrographs shown in FIG. 7C. The images in FIG. 7C were taken at 1000× and 5000×, respectively. The state of the surface of the nickel alloy is evidenced in FIG. 7C. With reference to FIG. 7D, an elemental analysis was performed on the surface of the nickel alloy. Notably, there is no evidence of oxygen (O). This is evidence of that no oxides are part of the coating of the nickel metal alloy. Such lack of oxides would be beneficial to the functioning of a nickel alloy aircraft part.

As shown herein, use of the solution and process in various embodiments may significantly and unexpectedly reduce the time associated with dissolving a ceramic material (e.g. a silica casting core, an alumina casting core, a zircon casting core, a magnesia casting core, and/or a casting core comprising mixtures of two or more of silica, alumina, magnesia and zircon), while preventing metallic aircraft part surfaces from damage due to, among other things, oxide formation. With reference to TABLE 3, etching attack depth may be increased nearly threefold by doubling concentration. Not only is this unexpected, the use of a corrosion inhibitor allows this large increase in attack depth to occur without harming the metallic aircraft part.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures.

The scope of the disclosures is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiment Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A solution comprising:

a strong base comprising KOH, the KOH has a concentration between 22.5 wt. % and 45 wt. % relative to a total weight of the solution;

a solubility enhancer comprising Ethylenediaminetetraacetic acid (EDTA); and a corrosion inhibitor comprising sodium tartrate.

2. The solution of claim 1, wherein the EDTA has a concentration of between 10 g/L and 30 g/L.

3. The solution of claim 1, wherein the concentration is between 30 wt. % and 45 wt. %.

4. The solution of claim 1, wherein the solution consists essentially of the strong base, the solubility enhancer, and the corrosion inhibitor.

5. The solution of claim 1, wherein the solution consists essentially of the KOH, the EDTA, and the sodium tartrate.

* * * * *